US008678383B2

(12) United States Patent
Niwano et al.

(10) Patent No.: US 8,678,383 B2
(45) Date of Patent: Mar. 25, 2014

(54) MULTIFEED PROCESSING APPARATUS WITH MEASURING UNIT FOR MULTIFEED DETECTION PATTERN

(71) Applicant: PFU Limited, Ishikawa (JP)

(72) Inventors: Tadashi Niwano, Ishikawa (JP); Shinji Suzuki, Ishikawa (JP)

(73) Assignee: PFU Limited, Ishikawa (JP)

( * ) Notice: Subject to any disclaimer, the term of this patent is extended or adjusted under 35 U.S.C. 154(b) by 0 days.

(21) Appl. No.: 14/037,165

(22) Filed: Sep. 25, 2013

(65) Prior Publication Data

US 2014/0021676 A1 Jan. 23, 2014

Related U.S. Application Data

(62) Division of application No. 13/044,138, filed on Mar. 9, 2011, now Pat. No. 8,567,776.

(30) Foreign Application Priority Data

May 14, 2010 (JP) ..... 2010-112448

(51) Int. Cl.
*B65H 7/12* (2006.01)

(52) U.S. Cl.
CPC ..... *B65H 7/12* (2013.01)
USPC ..... 271/262

(58) Field of Classification Search
USPC ..... 271/262
See application file for complete search history.

(56) References Cited

U.S. PATENT DOCUMENTS

| | | | |
|---|---|---|---|
| 3,938,435 | A | 2/1976 | Suda et al. |
| 7,654,521 | B2 | 2/2010 | Simonis et al. |
| 2003/0006550 | A1 | 1/2003 | Chujo et al. |
| 2004/0195760 | A1 | 10/2004 | Zimmermann et al. |
| 2005/0228535 | A1 | 10/2005 | Simonis et al. |
| 2006/0145412 | A1 | 7/2006 | Tagawa et al. |
| 2008/0036139 | A1 | 2/2008 | Reyner et al. |
| 2009/0085284 | A1 | 4/2009 | Tsuruoka |

FOREIGN PATENT DOCUMENTS

JP 2004-269241 A 9/2004

(Continued)

OTHER PUBLICATIONS

Fujitsu, P3PC-1432-04ENZ0, fi-5900C Image Scanner Operators Guide, Mar. 2007.*

(Continued)

*Primary Examiner* — Gerald McClain
(74) *Attorney, Agent, or Firm* — McDermott Will & Emery LLP

(57) ABSTRACT

A multifeed processing apparatus includes a control unit and a storage unit and is connected to a multifeed detecting mechanism and an image reading mechanism. The control unit includes (i) a measuring unit that measures a multifeed detection pattern from any one or both of an output of the multifeed detecting mechanism and an image of a medium read by the image reading mechanism, (ii) a determining unit that determines whether the measured multifeed detection pattern is included in a multifeed disable pattern stored in the storage unit, (iii) a reading control unit that regards a multifeed detection performed by the multifeed detecting mechanism as invalid, and causes the image reading mechanism to continue a reading operation, and (iv) a storage control unit that stores the measured multifeed detection pattern as the multifeed disable pattern in the storage unit.

1 Claim, 8 Drawing Sheets

(56) References Cited

FOREIGN PATENT DOCUMENTS

| | | | |
|---|---|---|---|
| JP | 2006-245953 | A | 9/2006 |
| JP | 2007-281777 | A | 10/2007 |
| JP | 2007-331909 | A | 12/2007 |
| JP | 2008-117056 | A | 5/2008 |
| JP | 2009-084003 | A | 4/2009 |
| JP | 2009-286581 | A | 12/2009 |

OTHER PUBLICATIONS

Canon Inc. User Manual (function detail) of scanner "DR-X10C" Chapter 8, p. 17. <http://cweb.canon.jp/manual/dr/pdf/drx10c-usermanual2.pdf>.

Fujitsu, P3PC-1432-04ENZO, fi-5900C Image Scanner Operator's Guide, Mar. 2007.

Decision of a Patent Grant issued in Japanese Patent Application No. 2010-112448 mailed Dec. 10, 2013, with English translation, 2 pgs.

* cited by examiner

MULTIFEED PROCESSING APPARATUS WITH MEASURING UNIT FOR MULTIFEED DETECTION PATTERN

RELATED APPLICATIONS

This application is a Divisional of U.S. patent application Ser. No. 13/044,138, filed on Mar. 9, 2011, which in turn is based upon and claims the benefit of priority from Japanese Patent Application No. 2010-112448, filed on May 14, 2010, the entire contents of which are incorporated herein by reference.

BACKGROUND OF THE INVENTION

1. Field of the Invention

The present invention relates to a multifeed processing apparatus, a multifeed processing method, and a multifeed processing program for processing a result of multifeed detection performed by a multifeed detecting function of an image reading apparatus (e.g., a scanner, a copier, and a facsimile).

2. Description of the Related Art

In a reading apparatus (e.g., Japanese Patent Application Laid-open No. 2004-269241) including a multifeed detecting function using an ultrasonic sensor, there is a case in which when the multifeed detecting function is enabled, a sticky note or the like attached to a paper is recognized as a multifeed and a reading operation is thereby stopped.

As means for avoiding this case, United States Patent Application No. 2005/0228535 discloses a technology for previously setting a length with which multifeed detection is disabled through a panel on a scanner before reading is started, and user manual (functional detail) of scanner "DR-X10C" released in home page of canon inc. "http://cweb.canon.jp/manual/dr/pdf/drx10c-usermanual2.pdf" discloses a technology for previously setting a starting position and an ending position at which multifeed detection is disabled through a screen on a personal computer connected to a scanner before reading is started.

However, according to the conventional technologies, there is a problem that it is necessary for a user to perform troublesome work and operation in such a manner that the user measures dimensions of a length and a position with which multifeed detection is disabled and inputs measured values.

SUMMARY OF THE INVENTION

It is an object of the present invention to at least partially solve the problems in the conventional technology.

A multifeed processing apparatus according to one aspect of the present invention includes a control unit and a storage unit. The multifeed processing apparatus is connected to a multifeed detecting mechanism and an image reading mechanism. The storage unit stores therein a multifeed detection pattern of an overlap starting position and an overlap length of a medium of which multifeed is detected by the multifeed detecting mechanism, or of the overlap length, or of a medium length and a ratio of the overlap length to the medium length, as a multifeed disable pattern for disabling multifeed detection performed by the multifeed detecting mechanism. The control unit includes (i) a measuring unit that, when a multifeed is detected by the multifeed detecting mechanism, measures the multifeed detection pattern from any one or both of an output of the multifeed detecting mechanism and an image of the medium read by the image reading mechanism, (ii) a determining unit that determines whether the multifeed detection pattern measured by the measuring unit is included in the multifeed disable pattern stored in the storage unit, (iii) a reading control unit that, when the determining unit determines that the multifeed detection pattern is included therein, regards the multifeed detection performed by the multifeed detecting mechanism as invalid, and causes the image reading mechanism to continue a reading operation, and (iv) a storage control unit that, when the determining unit determines that the multifeed detection pattern is not included therein, stores the multifeed detection pattern measured by the measuring unit as the multifeed disable pattern in the storage unit.

A multifeed processing method according to one aspect of the present invention is implemented by a control unit of a multifeed processing apparatus that includes the control unit and a storage unit and is connected to a multifeed detecting mechanism and an image reading mechanism. The multifeed processing method includes (i) a measuring step of, when a multifeed is detected by the multifeed detecting mechanism, measuring a multifeed detection pattern of an overlap starting position and an overlap length of a medium, or of the overlap length, or of a medium length and a ratio of the overlap length to the medium length, from any one or both of an output of the multifeed detecting mechanism and an image of the medium read by the image reading mechanism, (ii) a determining step of determining whether the multifeed detection pattern measured at the measuring step is included in a multifeed disable pattern which is stored in the storage unit and is the multifeed detection pattern for disabling multifeed detection performed by the multifeed detecting mechanism, (iii) a reading controlling step of, when it is determined at the determining step that the multifeed detection pattern is included therein, regarding the multifeed detection performed by the multifeed detecting mechanism as invalid, and causing the image reading mechanism to continue a reading operation, and (iv) a storage controlling step of, when it is determined at the determining step that the multifeed detection pattern is not included therein, storing the multifeed detection pattern measured at the measuring step as the multifeed disable pattern in the storage unit.

A multifeed processing program product according to one aspect of the present invention makes a control unit of a multifeed processing apparatus that includes the control unit and a storage unit and is connected to a multifeed detecting mechanism and an image reading mechanism implement a multifeed processing method. The multifeed processing method includes (i) a measuring step of, when a multifeed is detected by the multifeed detecting mechanism, measuring a multifeed detection pattern of an overlap starting position and an overlap length of a medium, or of the overlap length, or of a medium length and a ratio of the overlap length to the medium length, from any one or both of an output of the multifeed detecting mechanism and an image of the medium read by the image reading mechanism, (ii) a determining step of determining whether the multifeed detection pattern measured at the measuring step is included in a multifeed disable pattern which is stored in the storage unit and is the multifeed detection pattern for disabling multifeed detection performed by the multifeed detecting mechanism, (iii) a reading controlling step of, when it is determined at the determining step that the multifeed detection pattern is included therein, regarding the multifeed detection performed by the multifeed detecting mechanism as invalid, and causing the image reading mechanism to continue a reading operation, and (iv) a storage controlling step of, when it is determined at the determining step that the multifeed detection pattern is not included therein, storing the multifeed detection pattern measured at the measuring step as the multifeed disable pattern in the storage unit.

A recording medium according to one aspect of the present invention includes the multifeed processing program product described above.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
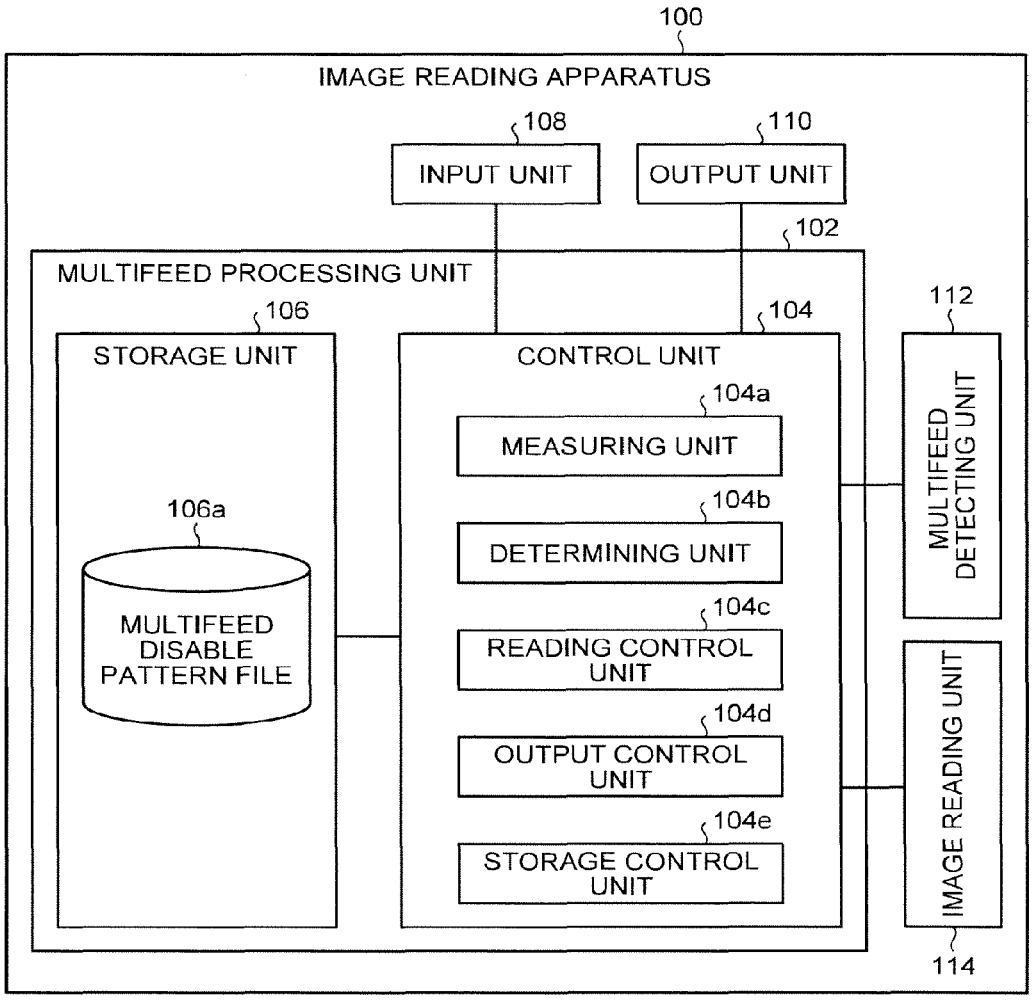
FIG. 1 is a diagram representing one example of a configuration of an image reading apparatus according to a present embodiment.

Embodiments of a multifeed processing apparatus, a multifeed processing method, and a multifeed processing program according to the present invention will be explained in detail below with reference to the accompanying drawings. It should be noted that the present invention is not limited by the embodiments. Particularly, in the embodiments, a case where the multifeed processing apparatus is implemented (incorporated) in an image reading apparatus will be explained as one example, however, the multifeed processing apparatus may be implemented in an information processing apparatus (personal computer) communicably connected to the image reading apparatus.

1. Configuration of Present Embodiment

Here, the configuration of an image reading apparatus 100 according to the present embodiment will be explained in detail with reference to FIG. 1 to FIG. 3.

1-1. Overview of Configuration

First, the overview of the configuration of the image reading apparatus 100 according to the present embodiment will be explained with reference to FIG. 1. FIG. 1 is a diagram representing the overview of the configuration of the image reading apparatus according to the present embodiment to which the multifeed processing apparatus according to the present invention is applied.

The image reading apparatus 100 includes a multifeed processing unit 102 corresponding to the multifeed processing apparatus according to the present invention, an input unit 108, an output unit 110, a multifeed detecting unit (mechanism) 112, and an image reading unit (mechanism) 114 in a functionally conceptual manner, and these units are communicably connected to each other through an arbitrary communication path.

The input unit 108 is used to cause a user to instruct storage of a multifeed detection pattern measured by a measuring unit 104*a* explained later, and is specifically an operation button (storage instruction button). The output unit 110 is used to display notification information for notifying multifeed detection performed by the multifeed detecting unit 112, and is specifically a display.

The multifeed detecting unit 112 is a mechanism for detecting a multifeed of a fed paper, and includes, for example, an ultrasonic sensor (hardware) for detecting the thickness of a paper using ultrasonic waves, and a processing unit (software) for detecting whether a multifeed occurs from an output of the ultrasonic sensor. A specific example of the configuration of the multifeed detecting unit 112 will be explained in detail later in "1-2. Specific Example of Configuration". The image reading unit 114 is a mechanism for reading a fed paper and generating an image of the paper.

The multifeed processing unit 102, as shown in FIG. 1, includes a control unit 104 and a storage unit 106 in a functionally conceptual manner. The storage unit 106 stores therein various types of databases, tables, and files, or the like. The storage unit 106 is a storage unit, which can be a memory device such as RAM (Random Access Memory) and ROM (Read Only Memory), a fixed disk drive such as a hard disk, a flexible disk, and an optical disc, or the like. The storage unit 106, as shown in this figure, stores therein a multifeed disable pattern file 106*a*. The multifeed disable pattern file 106*a* stores therein the multifeed detection pattern measured by the measuring unit 104*a*, explained later, as an multifeed disable pattern for disabling multifeed detection performed by the multifeed detecting unit 112.

The control unit 104 includes a CPU (Central Processing Unit) for controlling the image reading apparatus 100, and the like. The control unit 104 includes an internal memory for storing therein a control program such as OS (Operating System) and programs defining various processing procedures or the like and also storing therein required data, and performs information processes for executing various processes based on the programs. The control unit 104 includes the measuring unit 104*a*, a determining unit 104*b*, a reading control unit 104*c*, an output control unit 104*d*, and a storage control unit 104*e* in a functionally conceptual manner.

When a multifeed of a fed paper is detected by the multifeed detecting unit 112, the measuring unit 104*a* measures the following cases as multifeed detection patterns from an output of the multifeed detecting unit 112 (specifically, an output of the ultrasonic sensor included in the multifeed detecting unit 112) and/or an image of the fed paper read by the image reading unit 114 according to a previously specified measurement mode (any one of mode 1, mode 2, and mode 3) in each detected overlap area. The cases are such that "overlap starting position and overlap length" are measured when mode 1 is specified, "overlap length" is measured when mode 2 is specified, and "paper length and ratio of overlap length to the paper length" are measured when mode 3 is specified.

The determining unit 104*b* compares the multifeed detection pattern measured by the measuring unit 104*a* with the multifeed disable pattern stored in the multifeed disable pattern file 106*a*, and determines whether the multifeed detection pattern measured by the measuring unit 104*a* is included in the multifeed disable pattern. More specifically, when mode 1 is specified, the determining unit 104*b* determines whether the multifeed detection pattern of each of the overlap starting positions and the overlap lengths measured by the measuring unit 104*a* coincides with (is the same as) each of the multifeed disable patterns. Furthermore, when mode 2 is specified, the determining unit 104*b* determines whether the multifeed detection pattern of each of the overlap lengths measured by the measuring unit 104*a* is equal to or less than each overlap length of the multifeed disable patterns. In addition, when mode 3 is specified, the determining unit 104*b* determines whether the multifeed detection pattern of a paper length and each of ratios of the overlap lengths to the paper length measured by the measuring unit 104*a* coincides with (is the same as) each of the multifeed disable patterns.

The reading control unit 104*c* controls reading start and reading end of a paper by the image reading unit 114. When "coincide with (the same as)" or "equal to or less than" is determined by the determining unit 104*b*, the reading control unit 104*c* regards the multifeed detection performed by the multifeed detecting unit 112 as invalid, and causes the image reading unit 114 not to stop a reading operation of the paper but to continue the reading operation. When "error stop mode" is preset as error logic, the reading control unit 104*c* causes the image reading unit 114 to stop the reading operation of the paper. However, if not, the reading control unit 104*c* causes the image reading unit 114 not to stop the reading operation of the paper but to continue the reading operation.

When "not coincide with (not the same as)" or "not equal to or less than" is determined by the determining unit 104*b*, the output control unit 104*d* outputs notification information for notifying multifeed detection performed by the multifeed detecting unit 112 to the output unit 110.

When "not coincide with (not the same as)" or "not equal to or less than" is determined by the determining unit 104*b*, the storage control unit 104*e* stores the multifeed detection pattern measured by the measuring unit 104*a* (specifically, the overlap starting position and the overlap length in mode 1, a maximum value of the overlap length (maximum overlap length) in mode 2, and the paper length and the ratio of the overlap length to the paper length in mode 3), as the multifeed disable pattern, in a predetermined memory area of the multifeed disable pattern file 106*a*. When receiving an instruction for the notification information output by the output control unit 104*d* through the input unit 108 by the user (specifically, when the storage instruction button is pressed by the user), the storage control unit 104*e* stores the multifeed detection pattern measured by the measuring unit 104*a*, as the multifeed detection pattern, in a predetermined memory area of the multifeed disable pattern file 106*a*.

1-2. Specific Example of Configuration

Next, a specific example of the configuration of the image reading apparatus 100 will be explained in detail with reference to FIG. 2 and FIG. 3. A specific configuration of the image reading apparatus which is a scanner is explained herein, however, the image reading apparatus is not limited to the scanner, and thus can be applied to a copier, a facsimile, and the like.

Figure 2:
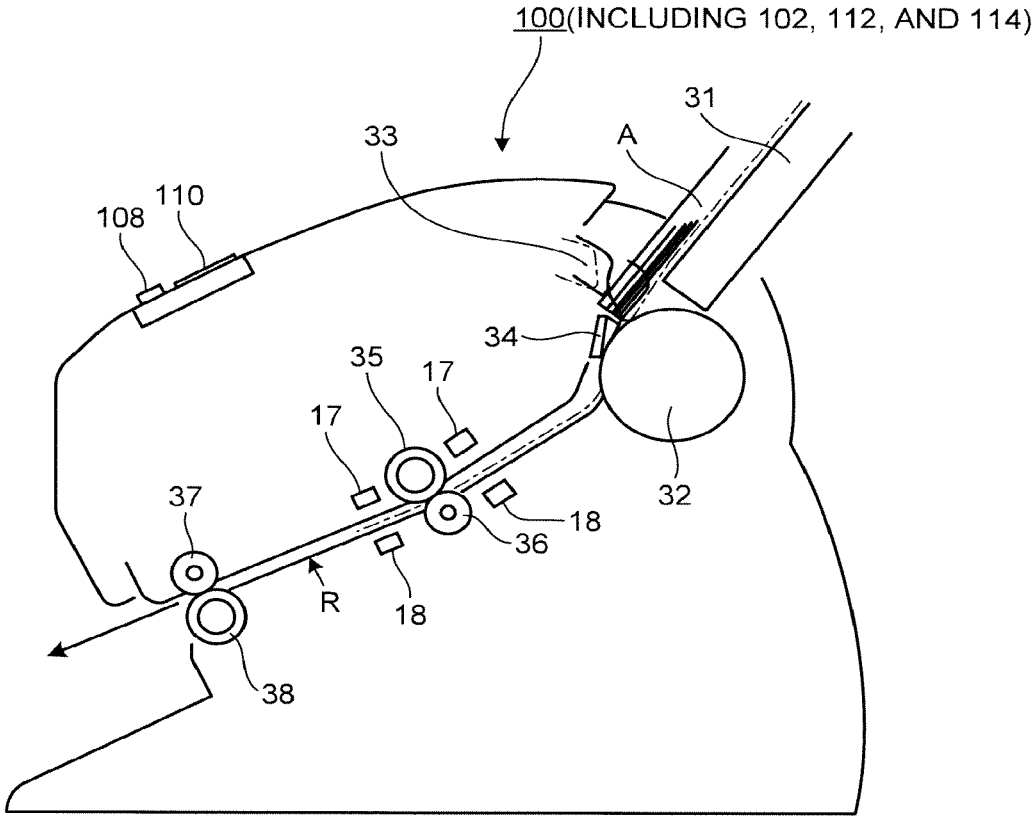
FIG. 2 is a schematic representing a configuration of a scanner being a specific example of the image reading apparatus according to the present embodiment.

FIG. 2 is a schematic representing an overview of a cross section of a scanner as the image reading apparatus 100 (hereinafter, sometimes described as "scanner 100"), and this figure shows an overview of the configuration of the scanner to which the multifeed processing unit 102, the input unit 108, the output unit 110, the multifeed detecting unit 112, and the image reading unit 114 are applied.

As shown in FIG. 2, the scanner 100 includes a paper mounting table (shooter) 31, a pick roller 32, a pick arm 33, a separation pad 34, feed rollers 35 and 36, and ejection rollers 37 and 38. The scanner 100 also includes a transmission-side ultrasonic sensor 17 and a reception-side ultrasonic sensor 18 of an ultrasonic detector, which is explained later, corresponding to the multifeed detecting unit 112. As shown in FIG. 2, the scanner 100 includes the storage instruction button 108 as the input unit and the display 110 as the output unit. In FIG. 2, a dashed two-dotted line indicates a feed path of a paper A, and an arrow R indicates a reading position of the paper A.

Papers A placed on the paper mounting table (shooter) 31 are picked by the pick roller 32 in a state where the papers A are applied with an appropriate pressing force by the pick arm 33. At this time, the papers A are sequentially separated from their lower side sheet by sheet by the pick roller 32 and the separation pad 34. The picked paper A is further fed to the feed rollers 35 and 36 by the pick roller 32, is fed to a reading position by the feed rollers 35 and 36, is read by the image reading unit 114 at the reading position, and is ejected by the ejection rollers 37 and 38. During feeding of the paper A along the feed path, a plurality of sheets (usually two sheets) or multiply fed papers A which are not separated into one sheet each even by the separation pad 34 are detected by the transmission-side ultrasonic sensor 17 and the reception-side ultrasonic sensor 18. Therefore, as shown in FIG. 2, the transmission-side ultrasonic sensor 17 and the reception-side ultrasonic sensor 18 are disposed on the upstream side of the reading position where the paper is read by the image reading unit 114 in the feed path. Particularly, the sensors are disposed on the downstream side or the upstream side of the feed rollers 35 and 36.

Figure 3:
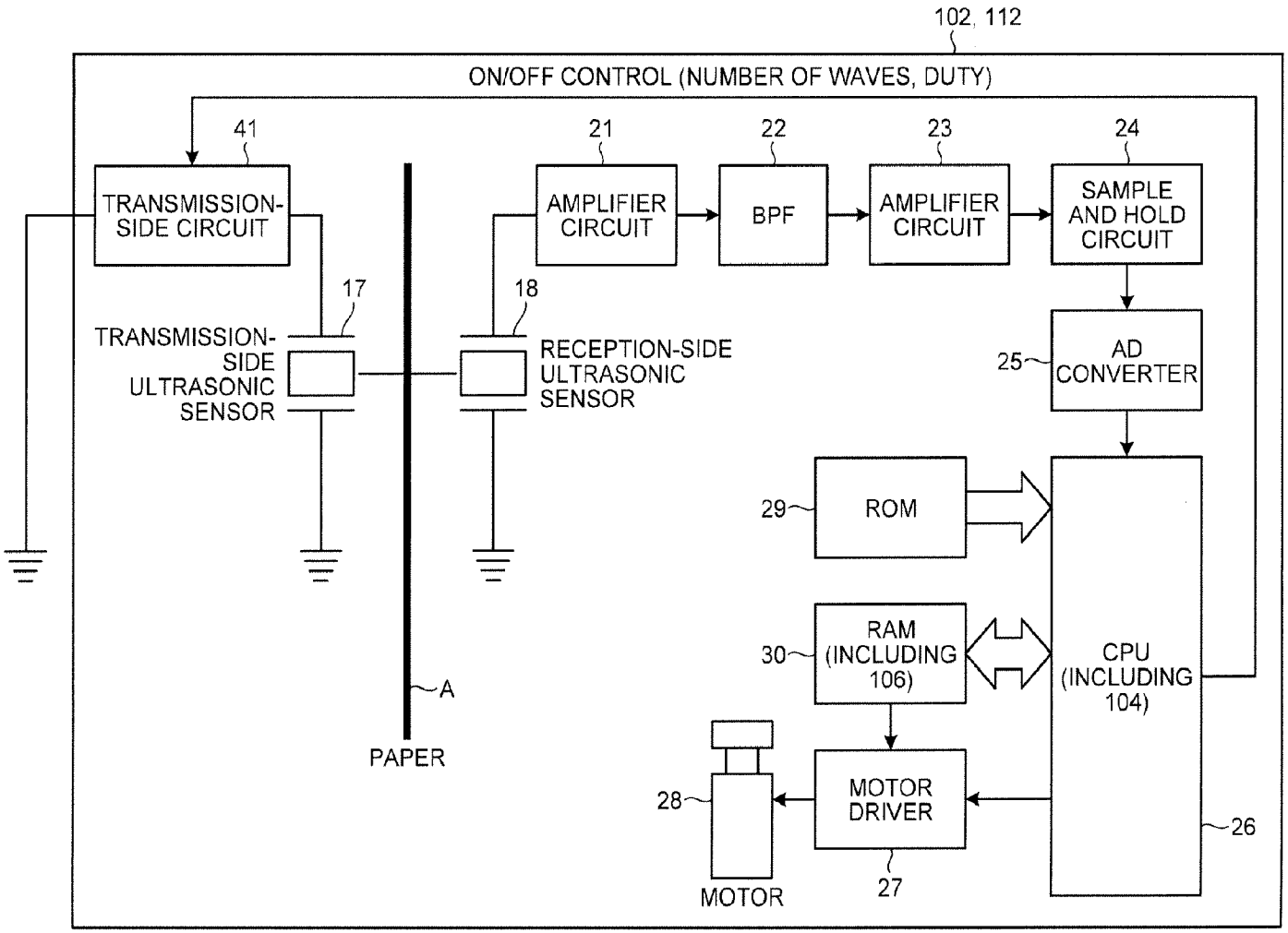
FIG. 3 is a diagram representing one example of a configuration of a multifeed processing unit and a multifeed detecting unit included in the scanner shown in FIG. 2.

FIG. 3 is a diagram representing one example of a specific configuration of the multifeed processing unit 102 and the multifeed detecting unit 112. In FIG. 3, the ultrasonic detector corresponding to the multifeed detecting unit 112 detects feeding of a plurality of papers A using ultrasonic waves. The ultrasonic detector includes the transmission-side ultrasonic sensor 17, a drive circuit thereof (transmission-side circuit, hereinafter the same) 41, the reception-side ultrasonic sensor 18, a setting unit (26) for setting a threshold used to detect feeding of a plurality of papers A (multifeed), and a detector (26) for detecting the feeding of the plurality of papers A.

The transmission-side ultrasonic sensor 17 emits an ultrasonic wave. The drive circuit 41 supplies a drive signal for driving the transmission-side ultrasonic sensor 17 thereto. The drive circuit 41 is configured with a circuit (which can ON/OFF control) that oscillates at a frequency near a resonant frequency of the transmission-side ultrasonic sensor 17. The reception-side ultrasonic sensor 18 is disposed so as to face the transmission-side ultrasonic sensor 17 across a paper feed path, and receives the ultrasonic wave. The setting unit sets a threshold used to detect the feeding of the plurality of papers A using an output of the reception-side ultrasonic sensor 18 as a reference value when an output of the transmission-side ultrasonic sensor 17 is stopped by the drive circuit 41. The detector compares the output of the reception-side ultrasonic sensor 18 with the threshold, and detects the feeding of the plurality of papers A.

The ultrasonic detector further includes an amplifier circuit 21 (at a first stage), a BPF (Band Pass Filter) 22, an amplifier circuit 23 (at a second stage), a sample and hold (S&H) circuit 24, an AD (Analog to Digital) converter 25, CPU 26, a motor driver 27, a motor 28, ROM 29, and RAM 30. These components constitute a reception-side circuit. More specifically, the reception-side ultrasonic sensor 18 outputs an electrical signal according to the ultrasonic wave received from the transmission-side ultrasonic sensor 17, the amplifier circuit 21 amplifies the electrical signal, the BPF removes noise therefrom, and, thereafter, the amplifier circuit 23 amplifies the signal after the noise is removed. Then, after the sample and hold circuit 24 samples and holds (SH) a peak value of the signal, the AD converter 25 converts the peak value (analog signal) into a digital value (digital signal). The AD converter 25 inputs the digital signal (input signal) to the CPU 26 (the setting unit and the detector therein), where it is analyzed. More specifically, the setting unit and the detector implemented by a setting and detection processing program (and hardware) on the CPU 26 analyze the input signal. The setting and detection processing program and the multifeed processing program are stored in, for example, the ROM 29 and/or the RAM 30. When a multifeed is detected, the CPU 26 (or the detector) transmits the drive signal to the motor driver 27, and causes the motor 28 to drive so as to stop feeding of (a plurality of) papers A. The CPU 26 includes processing units (from the measuring unit 104*a* to the storage control unit 104*e*) of the control unit 104 in the multifeed processing unit 102 in addition to the setting unit and the detector in the multifeed detecting unit 112. The RAM 30 stores therein the multifeed disable pattern file 106*a* of the storage unit 106 in the multifeed processing unit 102. When feeding of a plurality of papers is detected by the detector, the information is input to the measuring unit 104*a* of the multifeed processing unit 102, and the measuring unit 104*a* starts measuring the multifeed detection pattern.

The ultrasonic detector includes the transmission-side circuit (drive circuit) 41. The transmission-side circuit 41 is configured from a drive IC, a resistance/frequency-controlled oscillator (OSC), and a variable resistor. The drive IC is a drive circuit for supplying a drive signal to drive the transmission-side ultrasonic sensor 17 thereto. This causes the transmission-side ultrasonic sensor 17 to emit an ultrasonic wave. The reception-side ultrasonic sensor 18 receives the ultrasonic wave, and outputs a detection signal according to the intensity of the received ultrasonic wave. For example, when the paper A is not present between the transmission-side ultrasonic sensor 17 and the reception-side ultrasonic sensor 18, the reception-side ultrasonic sensor 18 detects a signal with a certain level (ordinary level), and detects a signal with a level (normal level) less than the ordinary level but more than a predetermined threshold when a sheet of paper A is present. When two sheets (or more) of paper A are present, the reception-side ultrasonic sensor 18 detects a signal with a level (abnormal level) less than the ordinary level and the threshold. For example, before feeding of the paper A, the drive IC is controlled so that the reception-side ultrasonic sensor 18 detects the signal with the ordinary level (in actual cases, the signal with a level equal to or more than the ordinary level). More specifically, the drive IC is controlled so that the drive frequency of the drive signal coincides with the resonant frequency of the transmission-side ultrasonic sensor 17 based on the ultrasonic wave received by the reception-side ultrasonic sensor 18 without using the variable resistor.

The setting unit sets (generates) a threshold used to detect feeding of a plurality of papers A using an output of the reception-side ultrasonic sensor 18 as a reference value when an output of the transmission-side ultrasonic sensor 17 is stopped by the drive circuit 41. The threshold is determined by adding a fixed value (correction value) to the output (average value of input signals from the reception-side ultrasonic sensor 18) of the reception-side ultrasonic sensor 18 when an output of the transmission-side ultrasonic sensor 17 is stopped. More specifically, the CPU 26 (sensor control unit therein) transmits a control signal to the transmission-side circuit 41 and causes the oscillation of the transmission-side circuit 41 to stop. The CPU 26 (sensor control unit therein) applies a predetermined bias voltage to the amplifier circuit 23 (computation amplifier therein). In this state, the CPU 26 (generation unit therein) repeatedly receives the input signals, tens of times, for example, 32 times, from the reception-side ultrasonic sensor 18 through the AD converter 25, and calculates an average value thereof to set the value as a reference value. More specifically, the signals at 32 points within, for example, one raster are measured. The CPU 26 (generation unit therein) corrects to add the correction value to the reference value and generates the threshold, and stores the threshold in the CPU 26 (register therein). Here, the correction value is determined empirically for each device to be installed allowing for the influence of noise or the like. It should be noted that the correction value may be determined beforehand and that the correction value may be determined, each time it is required, as a variable value for each device for allowing for influence of variation in sensitivity/sound pressure of the ultrasonic sensor, variation in fixture, surroundings, and adhesion of paper dust or the like.

The detector compares the output of the reception-side ultrasonic sensor 18 with the threshold, and detects feeding of a plurality of papers A. The CPU 26 (sensor control unit therein) transmits a control signal to the transmission-side circuit 41 and the like to cause the transmission-side circuit 41 to oscillate. Moreover, the CPU 26 (sensor control unit therein) applies a predetermined bias voltage to the amplifier circuit 23 (computation amplifier therein). In this state, the CPU 26 (comparator therein) repeatedly receives the input signals (digital values), tens of times, for example, 32 times, from the reception-side ultrasonic sensor 18 through the AD converter 25, and holds the received signals. At this time, the oscillation (transmission-side drive pulses) of the transmission-side circuit 41 is stopped and the signals at a plurality of predetermined positions, for example, at 32 points are measured. The measuring position is set to once in, for example, each raster or once in a plurality of rasters. When an output waveform of the reception-side ultrasonic sensor 18 is getting larger to become a maximum value, the maximum value is sampled and held. Next, the CPU 26 (sensor control unit or comparator therein) sets a timer for SH interrupt, and determines whether an interrupt occurs. The SH interrupt is set so as to occur 32 times when, for example, 32 input signals are to be obtained as explained above. In other words, the SH interrupt triggers continuous outputs of drive pulses in the transmission side. For example, 32 times of SH interrupts occur in once in each raster with the passage of a predetermined time. When the interrupt does not occur, the determination of occurrence of the interrupt is repeated. When an interrupt occurs, an average value of 32 values previously received and held, for example, a moving average value is calculated, and this value is determined as a value of an input signal used to detect the multifeed (MF). Thereafter, the CPU 26 (comparator therein) compares the value of the input signal with the threshold of the register. When the value of the input signal is equal to or more than the threshold, the CPU 26 (comparator therein) determines that the result is normal paper feeding, while when the value of the input signal is less than the threshold, the CPU 26 (comparator therein) determines whether the number of times in this case is predetermined times, for example, ten times or more. When it is determined that the number of times is 10 times or more, the CPU 26 (comparator therein) determines that a multifeed occurs, and outputs an error signal. When it is determined that the number of times is not 10 times or more, the following processes performed after the timer is set are repeated. The error signal is then input to the measuring unit 104*a* included in the CPU 26.

2. Process of Present Embodiment

Figure 4:
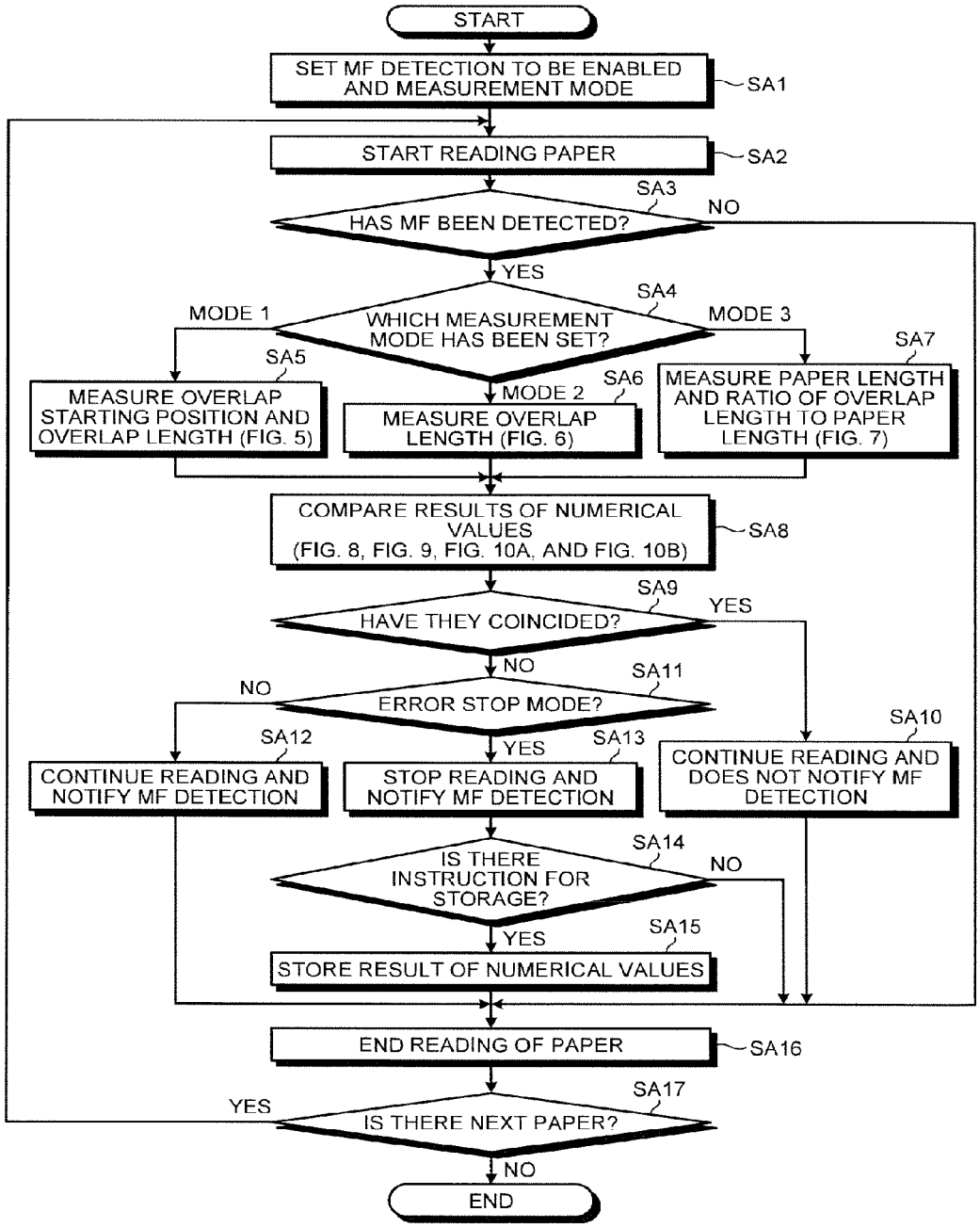
FIG. 4 is a flowchart representing one example of a main process of the present embodiment performed by the multifeed processing unit.

One example of a main process performed in the multifeed processing unit 102 of the image reading apparatus 100 configured in above manner will be explained with reference to FIG. 4 and the like. FIG. 4 is a flowchart representing one example of the main process.

First, the control unit 104 sets multifeed (MF) detection of the multifeed detecting unit 112 to be enabled and also sets any one of the measurement modes from mode 1 to mode 3 (Step SA1).

Next, the reading control unit 104*c* causes the image reading unit 114 to start reading the paper (Step SA2).

Next, when MF has been detected by the multifeed detecting unit 112 (Yes at Step SA3), the measuring unit 104*a* performs the following measurement process according to the measurement mode set at Step SA1 (from Step SA4 to Step SA7). When MF has not been detected (No at Step SA3), the control unit 104 proceeds the process to Step SA16.

Figure 5:
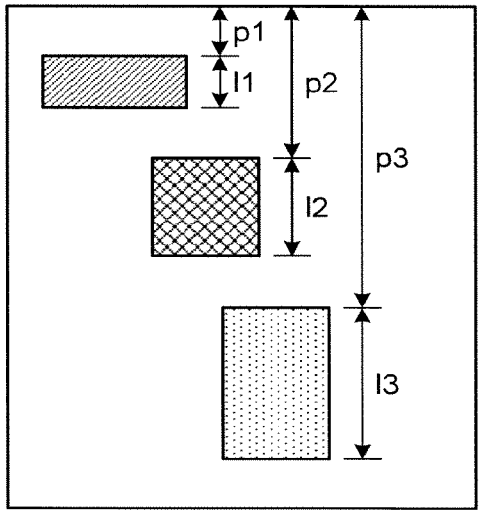
FIG. 5 is a diagram representing one example of a measurement process in a case of mode 1.

Specifically, when the measurement mode is mode 1 (Step SA4: mode 1), as shown in FIG. 5, the measuring unit 104*a* measures an overlap starting position $p_x$ and an overlap length $l_x$ as multifeed detection patterns for each overlap area, from an output from the ultrasonic sensor of the multifeed detecting unit 112 and/or from an image of the paper read by the image reading unit 114 (Step SA5). In FIG. 5, $p_1$, $p_2$, and $p_3$ represent "overlap starting position" for each overlap area of sticky notes or the like on the paper, and $l_1$, $l_2$, and $l_3$ represent "overlap length" for each overlap area of the sticky note or the like on the paper.

Figure 6:
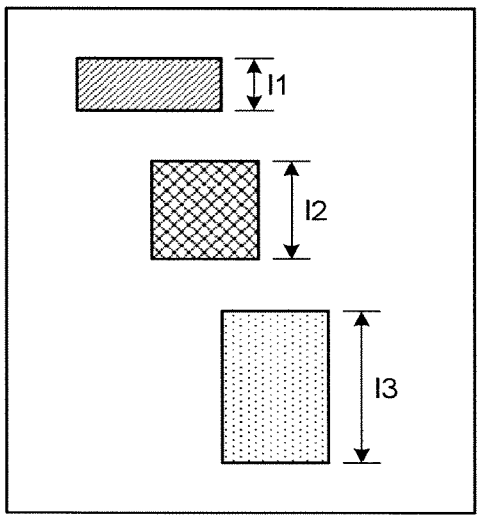
FIG. 6 is a diagram representing one example of a measurement process in a case of mode 2.

When the measurement mode is mode 2 (Step SA4: mode 2), as shown in FIG. 6, the measuring unit 104*a* measures an overlap length $l_x$ as a multifeed detection pattern for each overlap area, from the output from the ultrasonic sensor of the multifeed detecting unit 112 and/or from the image of the paper read by the image reading unit 114 (Step SA6). In FIG. 6, $l_1$, $l_2$, and $l_3$ represent "overlap length" for each overlap area of the sticky notes or the like on the paper.

Figure 7:
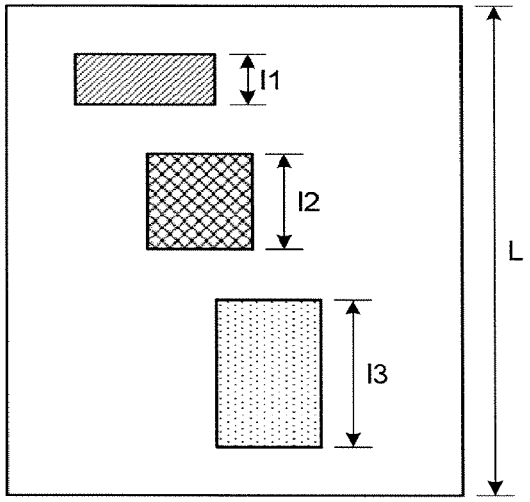
FIG. 7 is a diagram representing one example of a measurement process in a case of mode 3.

When the measurement mode is mode 3 (Step SA4: mode 3), as shown in FIG. 7, the measuring unit 104*a* measures a paper length L and a ratio $l_x/L$ of the overlap length to the paper length as a multifeed detection pattern for each overlap area, from the output from the ultrasonic sensor of the multifeed detecting unit 112 and/or from the image of the paper read by the image reading unit 114 (Step SA7). In FIG. 7, L represents "paper length", and $l_1$, $l_2$, and $l_3$ represent "overlap length" for each overlap area of the sticky notes or the like on the paper.

Referring back to FIG. 4, the determining unit 104*b* performs the following comparison process on the multifeed detection pattern measured at any one of steps from Step SA5 to Step SA7 and the multifeed disable pattern stored in the multifeed disable pattern file 106*a*, and determines whether the measured multifeed detection pattern is included in the multifeed disable pattern (Step SA8).

Figure 8:
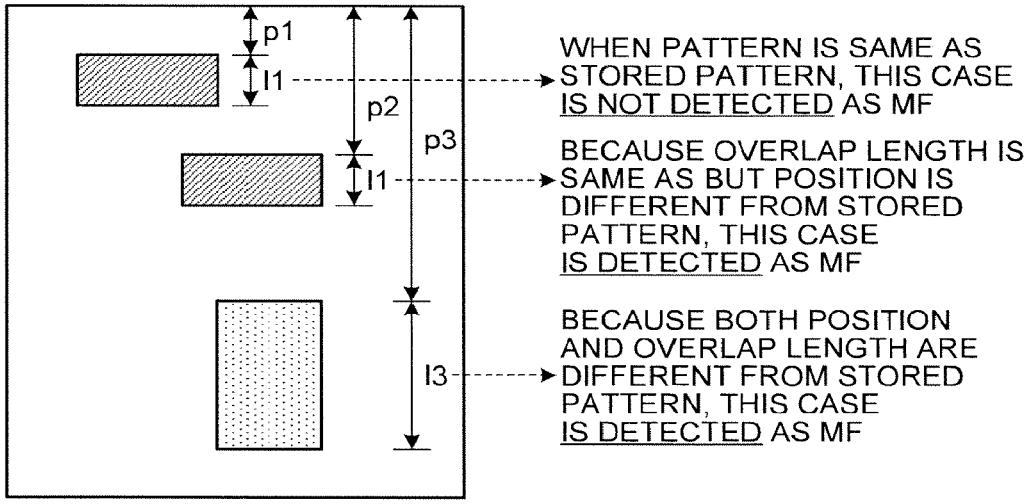
FIG. 8 is a diagram representing one example of a comparison process in the case of mode 1.

Specifically, when mode 1 is specified, the determining unit 104*b* determines whether the multifeed detection pattern of each of the overlap starting positions and the overlap lengths measured at Step SA5 coincides with (is the same as) each of the multifeed disable patterns stored in the multifeed disable pattern file 106*a*. For example, if the paper shown in FIG. 8 is fed when the overlap starting position $p_1$ and the overlap length $l_1$ are stored as the multifeed disable patterns, because the detection patterns of the overlap starting position $p_1$ and the overlap length $l_1$ are the same as the disable patterns, the determining unit 104*b* does not detect this case as a multifeed, while because the detection patterns of the overlap starting position $p_2$ and the overlap length $l_2$ and the detection patterns of the overlap starting position $p_3$ and the overlap length $l_3$ are different from the disable patterns, the determining unit 104*b* detects these cases as a multifeed.

Figure 9:
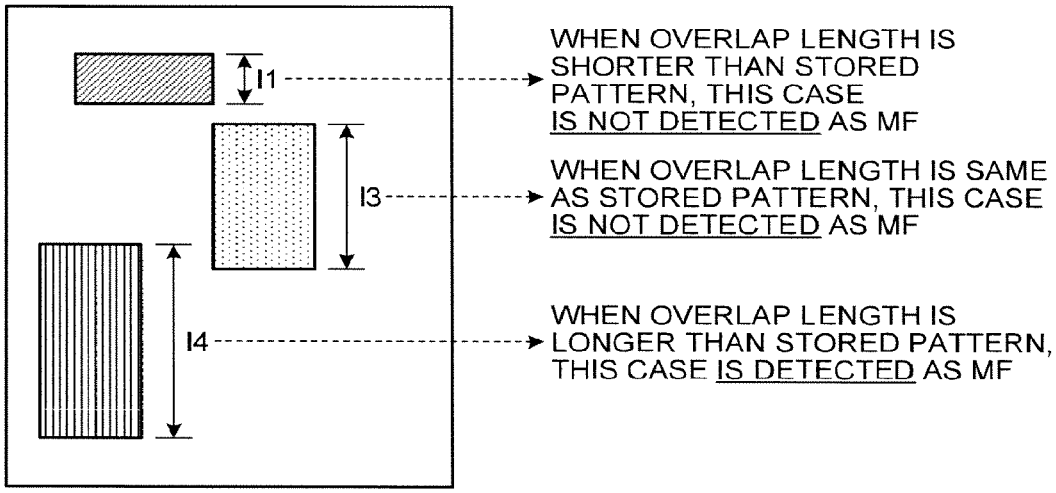
FIG. 9 is a diagram representing one example of a comparison process in the case of mode 2.

When mode 2 is specified, the determining unit 104*b* determines whether the multifeed detection pattern of the overlap length measured at Step SA5 is equal to or less than the overlap length stored in the multifeed disable pattern file 106*a* as the multifeed disable pattern. For example, if the paper shown in FIG. 9 is fed when the overlap length $l_3$ is stored as the multifeed disable pattern, because the overlap length $l_1$ is shorter than the overlap length $l_3$ of the disable pattern and the overlap length $l_3$ is equal to the overlap length $l_3$ of the disable pattern, the determining unit 104*b* does not detect this case as a multifeed, while because an overlap length $l_4$ is longer than the overlap length $l_3$ of the disable pattern, the determining unit 104*b* detects this case as a multifeed.

Figure 10A:
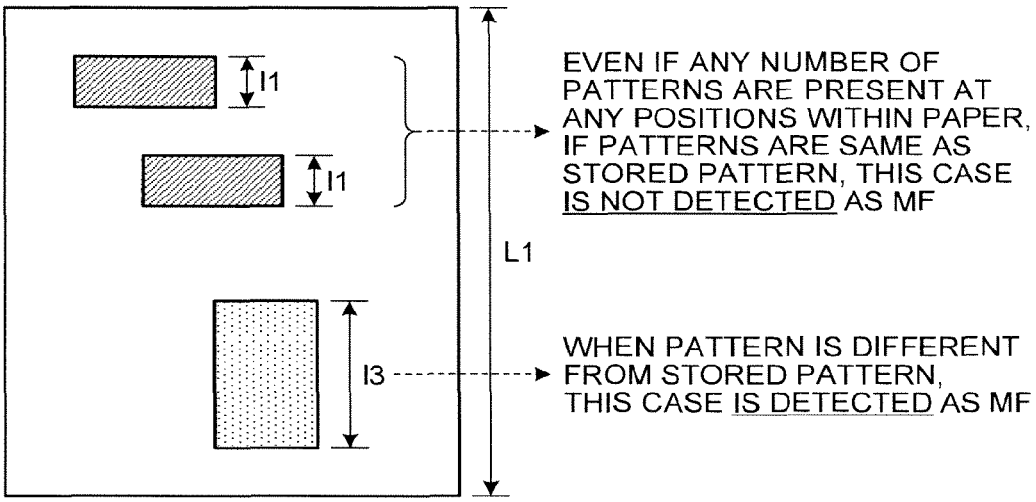
FIGS. 10A and 10B are diagrams representing one examples of a comparison process in the case of mode 3.
Figure 10B:
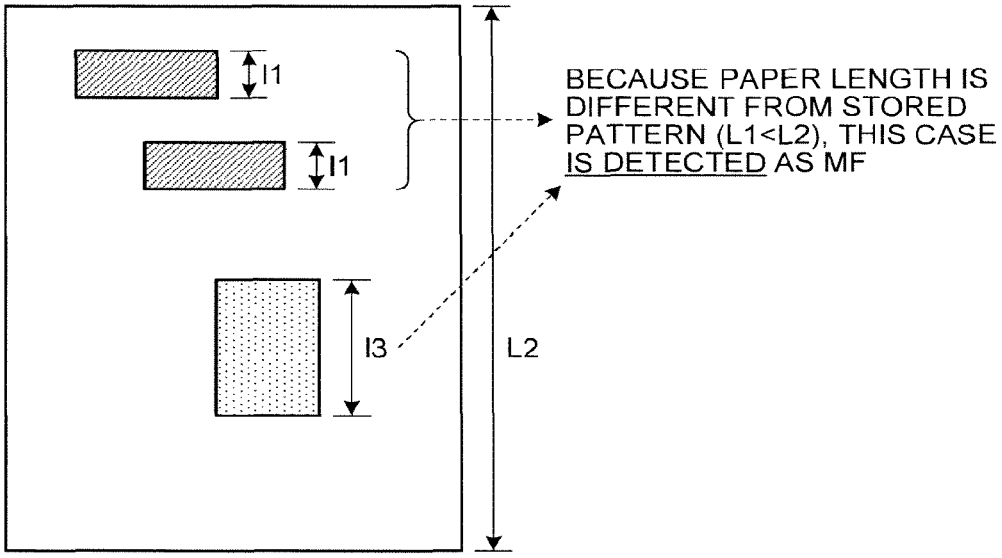

When mode 3 is specified, the determining unit 104*b* determines whether the multifeed detection pattern of the paper length and the ratio of the overlap length to the paper length measured at Step SA5 coincides with (is the same as) the multifeed disable pattern stored in the multifeed disable pattern file 106*a*. For example, if the paper shown in FIG. 10A is fed when a paper length $L_1$ and a ratio $l_1/L_1$ of the overlap length to the paper length are stored as the multifeed disable pattern, because the paper length of the paper is $L_1$ and thus if the detection pattern of the paper length $L_1$ and the ratio $l_1/L_1$ is the same as the disable pattern even if any number of patterns are present at any positions within the paper, the determining unit 104*b* does not detect this case as a multifeed, while because a detection pattern of the paper length $L_1$ and a ratio $l_3/L_1$ is different from the disable pattern, the determining unit 104*b* detects this case as a multifeed. In addition, for example, if the paper shown in FIG. 10B is fed when the paper length $L_1$ and the ratio $l_1/L_1$ of the overlap length to the paper length are stored as the multifeed disable pattern, because the paper length of the paper is $L_2$ which is longer than the $L_1$ and thus both the detection pattern of the paper length $L_2$ and the ratio $l_1/L_2$ and the detection pattern of the paper length $L_2$ and the ratio $l_3/L_2$ are different from the disable pattern, the determining unit 104*b* detects these cases as a multifeed.

Referring back to FIG. 4, when the result of determination at Step SA8 is "coincide with" or "equal to or less than" (Yes at Step SA9), the reading control unit 104*c* regards the multifeed detection performed by the multifeed detecting unit 112 as invalid, and causes the image reading unit 114 not to stop the reading operation of the paper but to continue the reading operation (Step SA10).

When the result of determination at Step SA8 is "not coincide with" or "not equal to or less than" or when the multifeed disable patterns are not stored in the multifeed disable pattern file 106*a* at Step SA8 (No at Step SA9), and if "error stop mode" is not set (No at Step SA11), then the reading control unit 104*c* causes the image reading unit 114 not to stop the reading operation of the paper but to continue the reading operation, and the output control unit 104*d* outputs notification information for notifying multifeed detection performed by the multifeed detecting unit 112 to the output unit 110 (Step SA12). When "error stop mode" is set (Yes at Step SA11), the reading control unit 104*c* causes the image reading unit 114 to stop the reading operation of the paper, and the output control unit 104*d* outputs the notification information for notifying multifeed detection performed by the multifeed detecting unit 112 to the output unit 110 (Step SA13).

Next, when the storage instruction button as the input unit 108 is pressed by the user for the notification information output at Step SA13 (Yes at Step SA14), the storage control unit 104*e* stores the multifeed detection pattern (the overlap starting position and the overlap length in mode 1, the maximum value of the overlap length in mode 2, and the paper length and the ratio of the overlap length to the paper length in mode 3) measured at any one of steps from Step SA5 to Step SA7, as the multifeed disable pattern, in a predetermined memory area of the multifeed disable pattern file 106*a* (Step SA15).

Next, the reading control unit 104*c* causes the image reading unit 114 to end the reading of the paper (Step SA16).

Then, when there is a next paper (Yes at Step SA17), the control unit 104 causes the processing units to execute Step SA2 to Step SA16, and ends the present main process when there is no next paper (No at Step SA17).

3. Summary of Present Embodiment, and Other Embodiments

As mentioned above, according to the present embodiment, when a multifeed is detected, the overlap starting position and the overlap length in mode 1, the overlap length in mode 2, and the paper length and the ratio of the overlap length to the paper length in mode 3 are measured for each area where the multifeed is detected, according to the specified measurement mode, and a multifeed error response is performed. Thereafter, when storage of a current multifeed pattern is instructed (a specified button is pressed) from an operator, the measured pattern is stored according to the specified mode. After the storage, when a multifeed occurs, the measured pattern is compared with the previously stored multifeed disable pattern (mode 1: the overlap starting position and the overlap length, mode 2: the maximum value of the overlap length (maximum overlap length), and mode 3: the paper length and the ratio of the overlap length to the paper length). If both of the patterns are not the same as each other, previously set error logic is executed (to stop if error occurs, or only alarm notification is provided), while if both of the patterns are the same as each other, this case is not regarded as the multifeed, and the paper (document) is received and the ordinary operation is continued. More specifically, with such a simple operation as pressing of the instruction button after the multifeed occurs, the current multifeed pattern (mode 1: the overlap starting position and the overlap length, mode 2: the maximum overlap length, and mode 3: the paper length and the ratio of the overlap area in the paper) is automatically stored, so that if a subsequent medium (paper) has the same pattern as above, it is not regarded as a multifeed. In this manner, there is eliminated a troublesome operation such that a multifeed disabled area is previously input and set using a panel of a scanner or using a tool of a PC (Personal Computer) unlike the conventional technology, thus improving the operability at the time of occurrence of a multifeed.

Moreover, the present invention may be implemented in various different embodiments in the scope of technical idea described in the appended claims other than the embodiment. For example, of the processes explained in the embodiment, all or part of the processes explained as automatically performed ones can be manually performed, or all or part of the processes explained as manually performed ones can be also automatically performed using known methods. A specific configuration of distribution or integration of the apparatuses is not limited to the illustrated one. The apparatuses can be configured by functionally or physically distributing or integrating all or part of the apparatuses in arbitrary units according to various types of additions or the like or according to functional loads. In addition, the process procedures, the control procedures, the specific names, and the screen examples shown in the present specification and the drawings can be arbitrarily modified unless otherwise specified.

The constituent elements of the image reading apparatus 100 shown in the drawings are functionally conceptual, and need not be physically configured as illustrated. For example, for the process functions provided in the image reading apparatus 100, especially for the process functions performed in the control unit 104, all or part thereof may be implemented by a CPU and programs interpreted and executed in the CPU, and may be implemented as hardware by wired logic. The programs are recorded in a recording medium, explained later, and they are mechanically loaded into the image reading apparatus 100 as required. More specifically, computer programs to perform various processes are recorded in the storage unit 106 such as ROM or an HD (Hard Disk). The computer programs are executed by being loaded into RAM, and form the control unit in cooperation with the CPU.

The multifeed processing apparatus according to the present invention may be configured as an information processing apparatus (including an information processing apparatus connected with arbitrary peripheral devices) such as known personal computers and work stations. The multifeed processing apparatus according to the present invention may be achieved by installing software (including the programs, the data, and the like) to implement the multifeed processing method according to the present invention. The multifeed processing program according to the present invention may be stored in a computer-readable recording medium, or can be configured as a program product. The "recording medium" mentioned here includes any "portable physical medium" such as a flexible disk, a magneto-optical disc, ROM, EPROM (Erasable Programmable Read Only Memory), EEPROM (Electronically Erasable and Programmable Read Only Memory), CD-ROM (Compact Disk Read Only Memory), MO (Magneto-Optical disk), and a DVD (Digital Versatile Disk) or includes a "communication medium" that temporarily holds a program, such as a communication line and a carrier used to transmit the program through a network such as LAN (Local Area Network), WAN (Wide Area Network), and the Internet. The "program" mentioned here is a data processing method described in arbitrary language and description method, and thus any form such as a source code and a binary code is acceptable. It should be noted that the "program" is not necessarily limited to a program configured as a single unit, and, therefore, includes those distributedly configured as a plurality of modules and libraries and those in which the function of the program is achieved in cooperation with separate programs represented as OS. Regarding a specific configuration and a reading procedure to read a recording medium by the apparatuses shown in the embodiments, or an installation procedure after the reading, or the like, known configuration and procedures can be used.

According to the present invention, (1) when a multifeed is detected by the multifeed detecting mechanism, the multifeed detection pattern ("overlap starting position and overlap length", "overlap length", or "medium length and ratio of overlap length to the medium length") is measured from an output of the multifeed detecting mechanism and/or an image of the medium read by the image reading mechanism, (2) it is determined whether the measured multifeed detection pattern is included in the multifeed disable pattern (the multifeed disable pattern for disabling multifeed detection performed by the multifeed detecting mechanism) stored in the storage unit, (3) when it is determined that the multifeed detection pattern is included therein, the multifeed detection performed by the multifeed detecting mechanism is regarded as invalid and the image reading mechanism is caused to continue a reading operation, and (4) when it is determined that the multifeed detection pattern is not included therein, the measured multifeed detection pattern is stored in the storage unit as the multifeed disable pattern. Thus, there is such an effect that the operability required when a multifeed is detected by the multifeed detecting function can be improved without causing the user to perform troublesome work and operation. Specifically, there is eliminated a troublesome operation such that a multifeed disabled area is previously input and set using a panel of a scanner or using a tool of a personal computer unlike the conventional technology, thus improving the operability at the time of occurrence of the multifeed.

According to the present invention, (4-1) when it is determined that the multifeed detection pattern is not included therein, notification information for notifying the multifeed detection performed by the multifeed detecting mechanism is output to the output unit, (4-2) when an instruction is received for the output notification information through the input unit, the measured multifeed detection pattern is stored in the storage unit as the multifeed disable pattern. Thus, there is such an effect that a multifeed disable pattern can be stored only by such a simple operation that an instruction is made through the input unit. Specifically, the operability at the time of occurrence of the multifeed can be improved only with such a simple operation that the instruction button as the input unit is pressed.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A multifeed processing program stored in a non-transitory computer-readable recording medium that makes a control unit of a multifeed processing apparatus that includes the control unit and a storage unit and is connected to a multifeed detecting mechanism and an image reading mechanism implement a multifeed processing method, the multifeed processing method comprising:

a measuring step of, when a multifeed is detected by the multifeed detecting mechanism, measuring a multifeed detection pattern of an overlap starting position and an overlap length of a medium, or of the overlap length, or of a medium length and a ratio of the overlap length to the medium length, from any one or both of an output of the multifeed detecting mechanism and an image of the medium read by the image reading mechanism;

a determining step of determining whether the multifeed detection pattern measured at the measuring step is included in a multifeed disable pattern which is stored in the storage unit and is the multifeed detection pattern for disabling multifeed detection performed by the multifeed detecting mechanism;

a reading controlling step of, when it is determined at the determining step that the multifeed detection pattern is included therein, regarding the multifeed detection performed by the multifeed detecting mechanism as invalid, and causing the image reading mechanism to continue a reading operation; and a storage controlling step of, when it is determined at the determining step that the multifeed detection pattern is not included therein, storing the multifeed detection pattern measured at the measuring step as the multifeed disable pattern in the storage unit.

* * * * *